US010185241B2

(12) United States Patent
Watanabe et al.

(10) Patent No.: US 10,185,241 B2
(45) **Date of Patent: *Jan. 22, 2019**

(54) IMAGE FORMING APPARATUS AND VOLTAGE APPLYING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Mitsutoshi Watanabe, Kannami Tagata Shizuoka (JP); Sunao Takenaka, Odawara Kanagawa (JP)

(73) Assignees: KABUSHIKI KAISHA TOSHIBA, Tokyo (JP); TOSHIBA TEC KABUSHIKI, Tokyo (JP)

( * ) Notice: Subject to any disclaimer, the term of this patent is extended or adjusted under 35 U.S.C. 154(b) by 16 days.

This patent is subject to a terminal disclaimer.

(21) Appl. No.: 15/688,978

(22) Filed: Aug. 29, 2017

(65) Prior Publication Data

US 2017/0357173 A1 Dec. 14, 2017

Related U.S. Application Data

(63) Continuation of application No. 15/157,524, filed on May 18, 2016, now Pat. No. 9,778,589.

(51) Int. Cl.
*G03G 15/02* (2006.01)
*G03G 15/06* (2006.01)

(52) U.S. Cl.
CPC ..... *G03G 15/0266* (2013.01); *G03G 15/0291* (2013.01); *G03G 15/065* (2013.01); *G03G 15/0275* (2013.01)

(58) Field of Classification Search
USPC ..... 399/38, 42, 44, 46, 50, 53–56
See application file for complete search history.

(56) References Cited

U.S. PATENT DOCUMENTS 4,847,657 A * 7/1989 Hanada ..... G03G 15/047 399/187
5,179,411 A 1/1993 Yoshiuchi et al.
(Continued)

FOREIGN PATENT DOCUMENTS

JP 2001-092197 4/2001
JP 2005-077544 3/2005

OTHER PUBLICATIONS

Non-Final Office Action for U.S. Appl. No. 15/157,524 dated Dec. 15, 2016.

(Continued)

*Primary Examiner* — Hoan Tran
(74) *Attorney, Agent, or Firm* — Amin, Turocy & Watson LLP

(57) ABSTRACT

According to one embodiment, a charger charges a surface of an image carrier by discharge in a wide-angle. A charging bias voltage application section applies a charging bias voltage to the charger. An exposing device forms an electrostatic latent image in a charged image carrier. A toner carrier causes toner to adhere to the electrostatic latent image formed in the image carrier. A developing bias voltage application section applies the developing bias voltage to the toner carrier. In addition, the developing bias voltage application section changes the charging bias voltage in one step and changes the developing bias voltage applied to the toner carrier in multiple steps.

5 Claims, 5 Drawing Sheets

(56) References Cited

U.S. PATENT DOCUMENTS

| | | | | |
|---|---|---|---|---|
| 5,245,389 | A | 9/1993 | Yoshiyama et al. | |
| 8,929,756 | B2 | 1/2015 | Nakagawa | |
| 9,086,646 | B2 | 7/2015 | Fukusaka | |
| 9,383,676 | B2 | 7/2016 | Hironaka et al. | |
| 9,459,575 | B2 * | 10/2016 | Matsushita | G03G 15/50 |
| 9,778,589 | B1 * | 10/2017 | Watanabe | G03G 15/0266 |

OTHER PUBLICATIONS

Non-Final Office Action for U.S. Appl. No. 15/688,976 dated Feb. 9, 2018.

* cited by examiner

IMAGE FORMING APPARATUS AND VOLTAGE APPLYING METHOD

CROSS-REFERENCE TO RELATED APPLICATIONS

This application is a Continuation of application Ser. No. 15/157,524 filed on May 18, 2016, the entire contents of which are incorporated herein by reference.

FIELD

Embodiments described herein relate generally to an image forming apparatus and a voltage applying method.

BACKGROUND

In the related art, in an image forming apparatus such as a Multi Function Peripheral (MFP), a developing bias is applied to a developing roller and the like to develop an image when generating the image.

In an image forming apparatus for performing two-component development with a reversal developing system, a carrier is prevented from adhering to a photoconductive member in the following manner. For example, the image forming apparatus applies the developing bias to a developing roller at a timing earlier than a timing when a charged photoconductive element faces the developing roller. However, in this case, the developing roller to which the developing bias is applied faces a photoconductive element region in which charging is insufficient. Therefore, toner adheres to a region in which charging of the photoconductive element is insufficient. Then, it is necessary to perform processing so that the toner adhered to the region does not appear in an output image.

DETAILED DESCRIPTION

An image forming apparatus of an embodiment includes a charger, a charging bias voltage application section, an exposing device, a toner carrier, and a developing bias voltage application section. The charger charges a surface of an image carrier in a wide-angle by discharge. The charging bias voltage application section applies a charging bias voltage to the charger. The exposing device forms an electrostatic latent image in a charged image carrier. The toner carrier causes toner to adhere to the electrostatic latent image formed in the image carrier. The developing bias voltage application section applies the developing bias voltage to the toner carrier. In addition, the charging bias voltage application section changes the charging bias voltage in one step. The developing bias voltage application section changes the charging bias voltage in one step and changes the developing bias voltage applied to the toner carrier in multiple steps.

Hereinafter, an image forming apparatus and a voltage applying method of the embodiment will be described with reference to the drawings.

Figure 1:
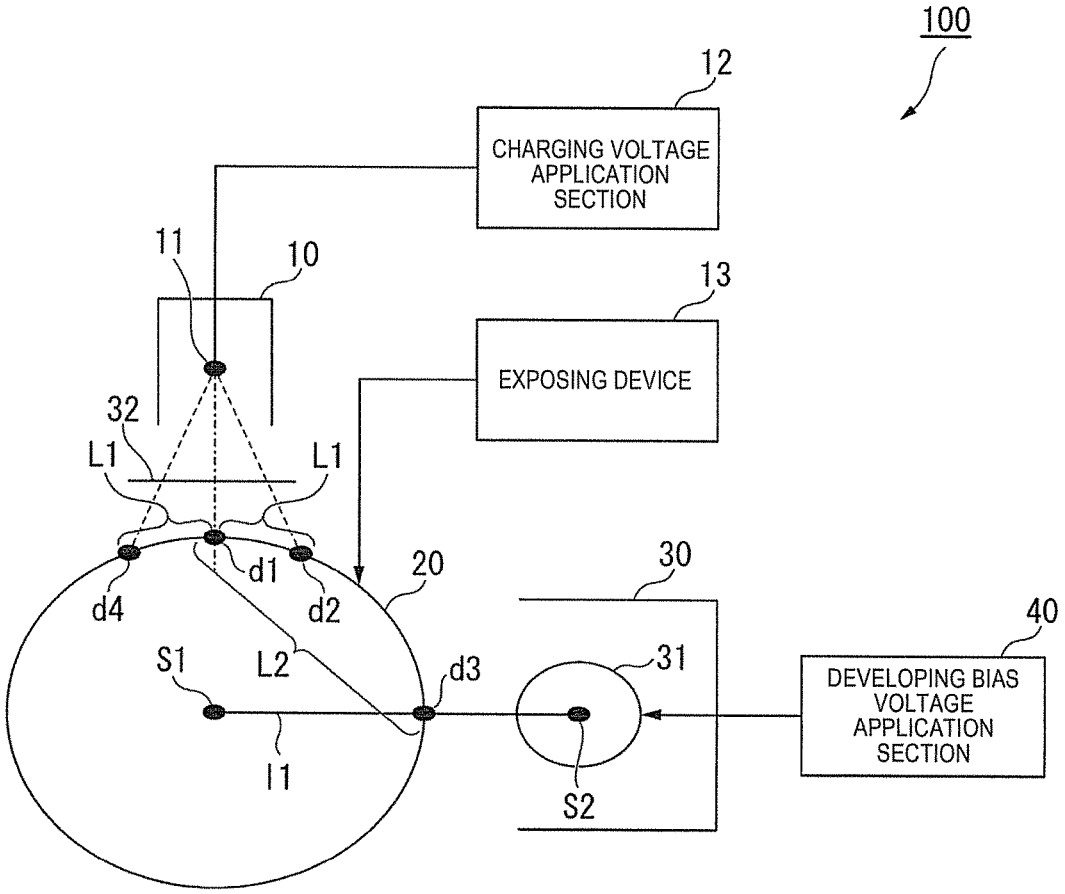
FIG. 1 is a configuration diagram of a part of an image forming apparatus of an embodiment.

FIG. 1 is a configuration diagram of a part of an image forming apparatus 100 of the embodiment. The image forming apparatus 100 is, for example, an image forming apparatus such as a complex machine. A configuration of the image forming apparatus 100 performing a process from charge to development is illustrated in FIG. 1. As illustrated in FIG. 1, the image forming apparatus 100 includes a charger 10, a charging voltage application section 12, an exposing device 13, a photoconductive element 20, a developing device 30, and a developing bias voltage application section 40.

The charger 10 charges a surface (photoconductive element layer) of the photoconductive element 20 in a wide-angle by corona discharge. For example, the charger 10 charges the surface of the photoconductive element 20 to be a negative polarity. Therefore, an electrostatic latent image is formed on the surface of the photoconductive element 20 by the exposing device 13.

Here, a structure of the charger 10 will be described with reference to FIG. 2.

Figure 2:
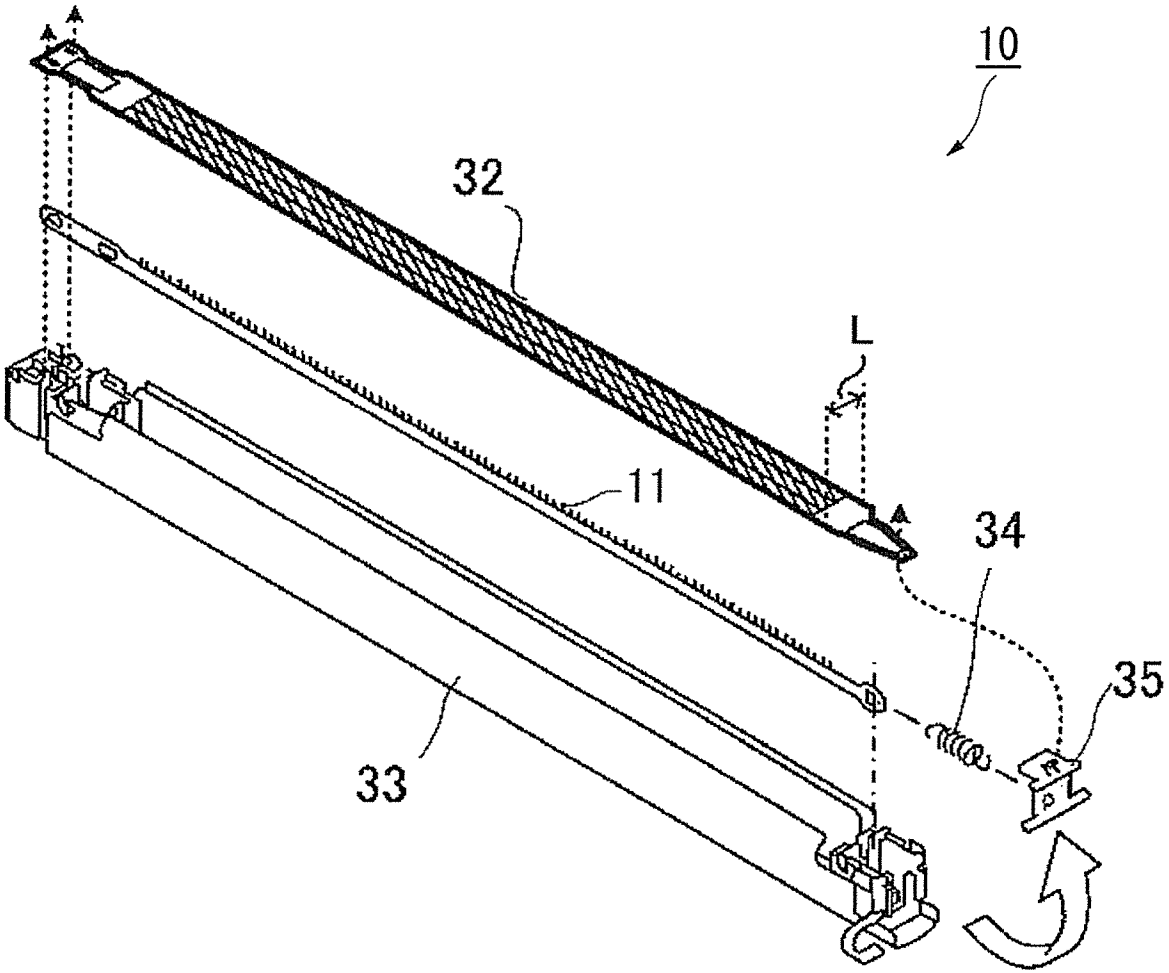
FIG. 2 is a view of a charger according to the embodiment.

FIG. 2 is a view illustrating an example of a corona charger as the charger 10. The charger 10 has a structure in which a charging electrode 11 and a charging grid 32 for performing discharge charge control on a photoconductive element 20 side are fixed by a spring 34 and an arm 35 of a holding section of a charging case 33. The charging electrode 11 is formed of a stainless steel (SUS) material in which acute or cylindrical needle-shaped protrusions are formed at equal intervals (for example, 2 mm intervals and the like). The charging grid 32 is disposed in a grid center portion by being spaced apart 1 mm from the surface of the photoconductive element 20 and a distance between the charging electrode 11 and the grid center portion is 10 mm.

The charger 10 performs discharge by applying a high voltage to the charging electrode 11 and charges the photoconductive element 20. If a high voltage is applied to the charging electrode 11, air around needle electrode is charged and the surface of the photoconductive element 20 facing the charging electrode 11 is charged. This phenomenon is called corona discharge, a grid bias voltage as a control bias is applied to the grid 32, and thereby a charging amount is controlled.

Returning to FIG. 1, description of the image forming apparatus 100 will be continued.

The charging voltage application section 12 applies a charging bias voltage to the charger 10.

The exposing device 13 forms the electrostatic latent image by applying laser beams to the charged image carrier.

The photoconductive element 20 has the photoconductive element layer on the surface. The photoconductive element 20 is rotated in the clockwise direction by driving of a developing motor.

The developing device 30 includes a developing roller 31 as a developer carrier (toner carrier) and develops the electrostatic latent image formed on the surface of the photoconductive element 20 by the developer. The developer is composed of a carrier and toner. The developer carrier carries the carrier in addition to the toner. The developing device 30 is rotated in the counterclockwise direction by driving of the developing motor. The developing roller 31 is connected to the developing bias voltage application section 40.

The developing bias voltage application section 40 applies a developing bias voltage to the developing roller 31. The voltage applied to the developing roller 31 is, for example, a negative DC voltage. In the embodiment, a charging potential of the photoconductive element 20 is set at −600 V and a developing bias potential is set at −400 V. The developing bias voltage application section 40 applies voltages different in multiple steps to the developing roller 31 until a voltage is set up in a developing bias of a target.

The charging potential of the photoconductive element 20 when the charging bias voltage applied to the charger 10 is changed will be described with reference to FIG. 1. A change of the charging bias voltage is performed after the image forming apparatus 100 executes an image quality maintenance mode. The image quality maintenance mode is a mode for changing process conditions (for example, the charging bias voltage and the developing bias voltage) for forming an image in accordance with a state of the image forming apparatus 100 or the environment surrounding the image forming apparatus 100. The image forming apparatus 100 executes the image quality maintenance mode and thereby it is possible to maintain the image quality equal to or greater than a predetermined level even if the environment and the like are changed. The state of the image forming apparatus 100 can be represented by the number or time of execution of image formation. For example, the image forming apparatus 100 executes control by the image quality maintenance mode for every 500 sheets. In addition, the environment surrounding the image forming apparatus 100 is an ambient temperature, an ambient humidity, and the like. The image forming apparatus 100 measures the ambient temperature and the ambient humidity, and if the environment is changed in excess of a predetermined range, the process conditions are changed to new process conditions.

FIG. 1 describes that the charging potential is charged to −650 V after executing the image quality maintenance mode at a portion in which the charging potential before the image quality maintenance mode is performed is −600 V.

The photoconductive element 20 is charged at a moment when a voltage after a change required for charging the photoconductive element 20 to −650 V is applied from the charging voltage application section 12 to the charging electrode 11 within the charger 10, but the charging potential is not uniform. The reason is that discharge is started by the charger 10 at a moment when a voltage is applied to the charging electrode 11, but a reaching amount of a discharge charge, that is, a charging amount is different between a point d1 and a point d2.

Here, the point d1 indicates a point of the photoconductive element 20 closest to the charging electrode 11 (or the grid 32) and, in the embodiment, indicates a region of the photoconductive element 20 which is positioned beneath the charging electrode 11. The charging electrode 11 configures a center of discharge. The point d2 indicates a point of which a distance is farthest away from the charging electrode 11 in a reaching range of the discharge from the charging electrode (or the grid 32). However, the reaching amount of the discharge charge is reduced as the distance from the charging electrode 11 is increased (separated). Therefore, the discharge charge after the change does not reach portions based on the point d2 as a border. Therefore, the point d2 is also a border point where the discharge charge does not substantially reach.

The point d1 is charged to a value substantially close to −650 V of the charging potential at the point in time when the charging bias voltage after changed is applied. On the other hand, the point d2 is charged to a potential, for example, −600 V that is charged by the charging bias voltage before changed. That is, a difference occurs in the charging potential between the point d1 and the point d2. The potentials of the point d1 and the point d2 are substantially linearly changed. Then, regions having such a potential difference sequentially face the developing roller 31 due to a rotation of the photoconductive element 20.

Here, a position facing the photoconductive element 20 and the developing roller 31, more specifically, a contact point between a line 11 connecting a rotary shaft S1 of the photoconductive element 20 and a rotary shaft S2 of the developing roller 31, and the photoconductive element 20 is d3. In this case, a size (per unit time) of a change of the charging potential of the photoconductive element 20 passing through the contact point d3 is represented as the following Expression 1. The line 11 indicates a line connecting a rotation center of the photoconductive element 20 and a rotation center of the developing roller 31.

$$(Vg1-Vg2)/(L1/Vp)(V/\text{sec}) \qquad \text{(Expression 1)}$$

In Expression 1, Vg1 indicates the charging potential that is charged at the point d1 when the charging bias voltage after changed is applied to the charger 10. Vg2 indicates the charging potential that is charged at the point d2 when the charging bias voltage after changed is applied to the charger 10. In the embodiment, |Vg1|>|Vg2| is satisfied. L1 is a distance (mm) of an arc of the photoconductive element 20 from the point d1 to the point d2 and Vp (mm/sec) is a process speed, that is, a peripheral speed of the photoconductive element 20.

In the embodiment, the developing bias voltage is applied from the developing bias voltage application section 40 to the developing roller 31 facing a region of the photoconductive element 20 having such a potential difference in multiple steps.

Figure 3:
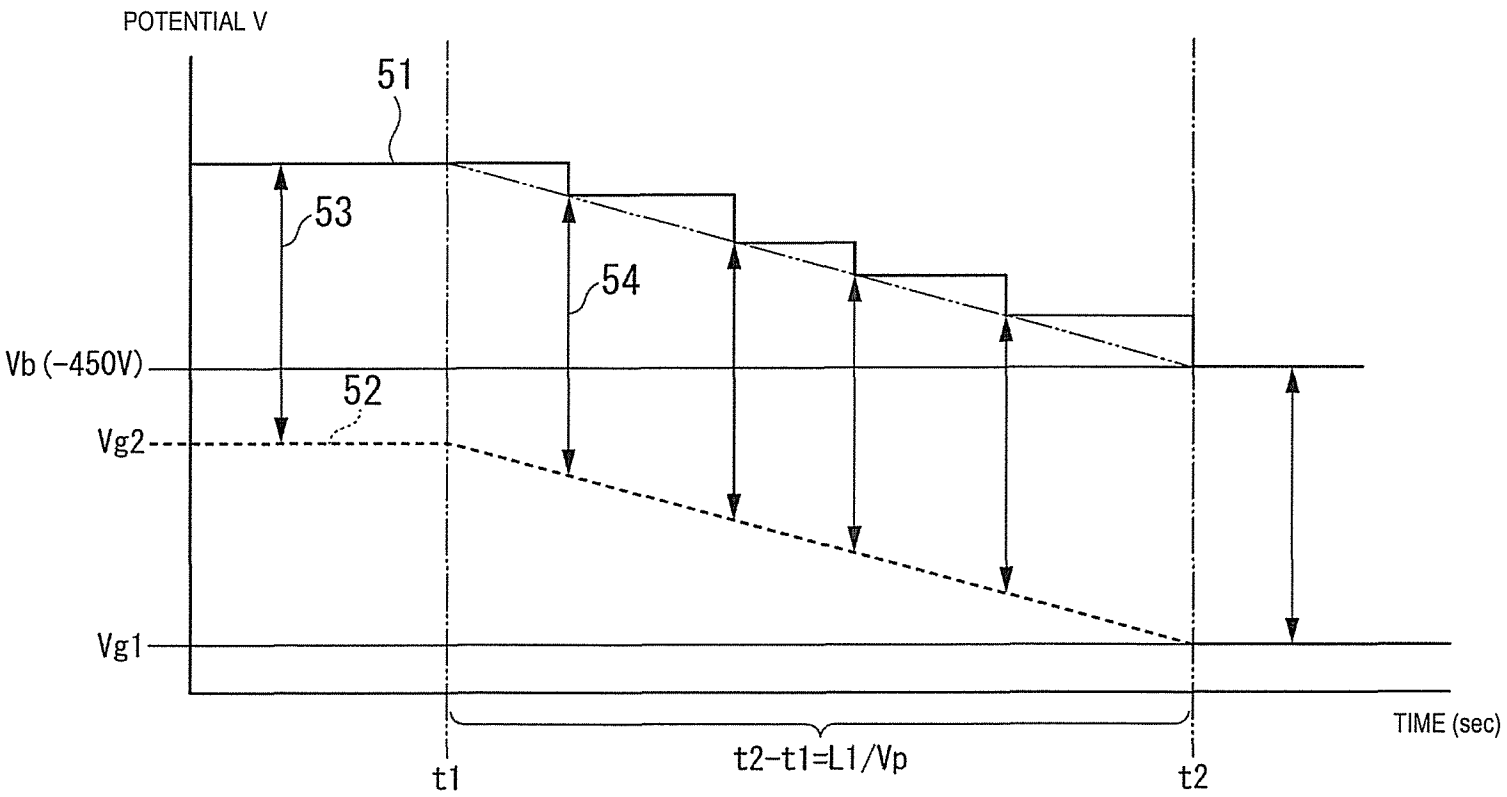
FIG. 3 is a diagram representing the developing bias set-up control according to the embodiment.

FIG. 3 is a diagram representing a change (graph 52) of the potential of the photoconductive element 20 passing through the point d3 of FIG. 1 and the developing bias voltage (graph 51) of the developing roller 31 applied at this time. In FIG. 3, a vertical axis indicates a potential and a horizontal axis indicates an elapsed time t. Since the embodiment employs a negative reversal development, 0 V is adopted in an upward direction of the vertical axis and a negative potential is adopted in a downward direction of the vertical axis in FIG. 3.

As described above, the charging potential of the photoconductive element 20 facing the point d3 is changed from Vg2 to Vg1. The timing when the region of the photoconductive element 20 charged to the potential Vg2 faces the point d3 is indicated as a time t1 in FIG. 3. In addition, the timing when the region of the photoconductive element 20 charged to the potential Vg1 faces the point d3 is indicated as a time t2 in FIG. 3. Here, t2−t1=L1/Vp. Therefore, a slope of a straight line from the time t1 to the time t2 of the graph 52 becomes (Vg1−Vg2)/(L1/Vp).

In the embodiment, −400 V is applied to the developing roller 31 before the time t1. However, a predetermined developing bias Vb=−450 V is applied to the developing roller 31 at the time t2. This is because it is necessary to maintain a potential difference between a potential after exposure of the photoconductive element 20 and the potential of the developing roller 31, and a potential difference between the charging potential of the photoconductive element 20 and the potential of the developing roller 31 constant (for example, 200 V) to prevent carrier adhesion even if the charging voltage is changed.

The developing bias voltage applied to the developing roller 31 is applied in multiple steps so as to substantially match to a slope |Vg1−Vg2|/(L1/Vp) between t1 and t2 of the graph 52.

The slope between t1 and t2 is uniquely determined by the size of the photoconductive element 20 and the process speed. Therefore, the developing bias voltage may be changed in multiple steps in a permissible range in consideration of a time required to switch the developing bias voltage. That is, since transition of the developing bias voltage is linearly changed as the number of switching occurrences of the developing bias voltage is increased, the transition can be performed with a predetermined potential difference in the change of the potential of the photoconductive element 20.

The timing when the developing bias voltage is applied in multiple steps is the timing after (L2−L1)/Vp (sec) has elapsed from the start of charging. Here, L2 indicates an arc length of the photoconductive element 20 from the point d1 to the point d3. Thereafter, the developing bias voltage application section 40 starts application of the developing bias voltage to the developing roller 31. Then, the developing bias voltage application section 40 sets up the developing bias in multiple steps so that the developing bias sets up to a predetermined developing bias value until a predetermined time L1/Vp (sec) has elapsed.

Figure 4:
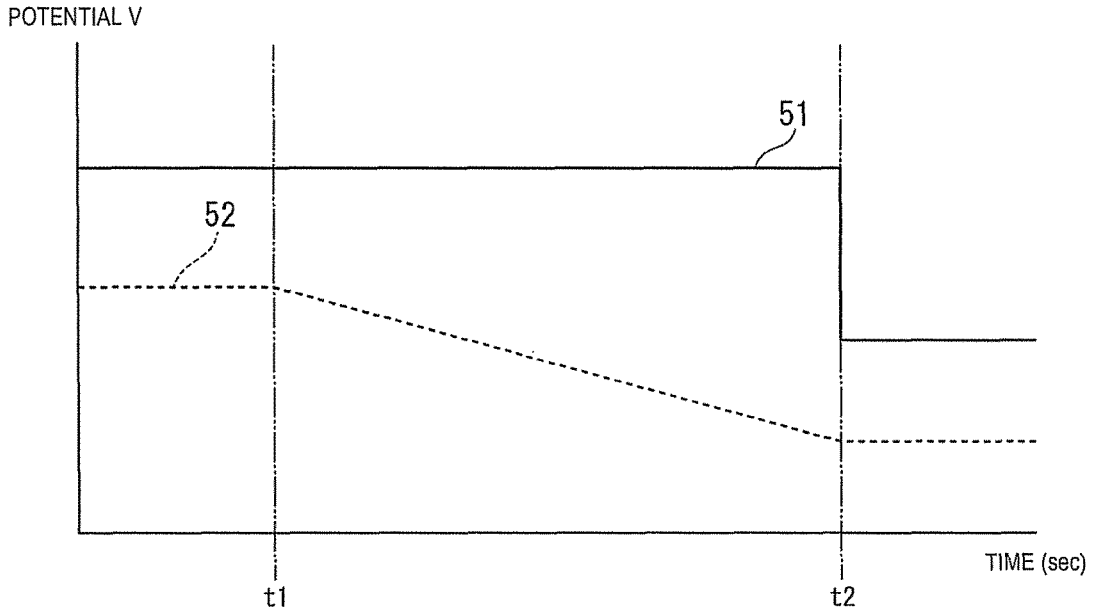
FIG. 4 is a diagram illustrating a state in which a developing bias voltage is set up at one time as a comparison example.
Figure 5:
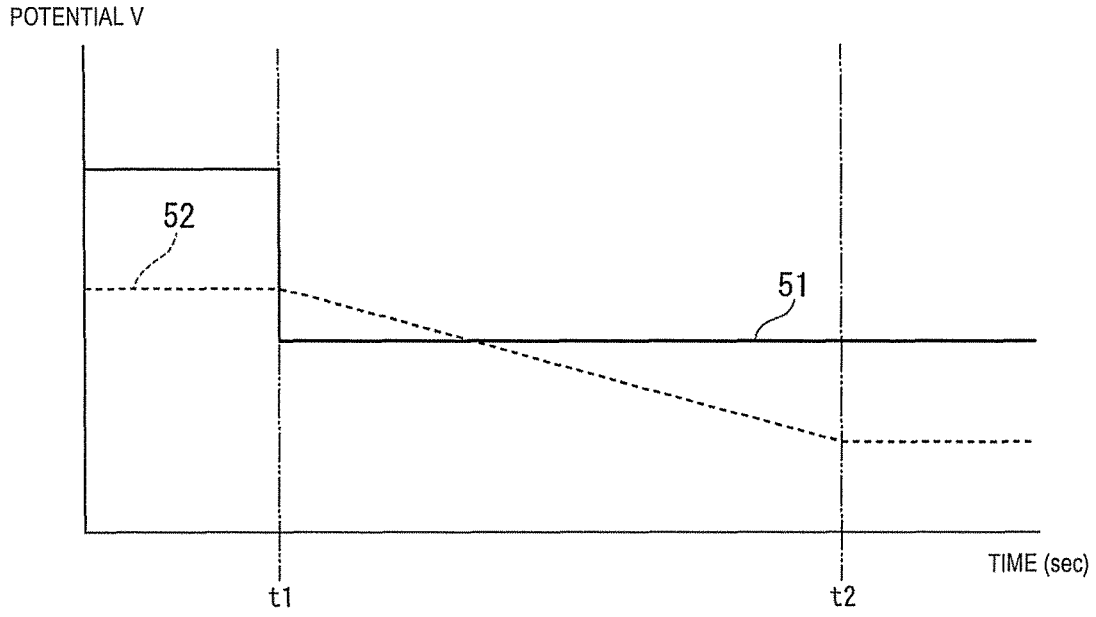
FIG. 5 is a diagram illustrating a state in which a developing bias voltage is set up at one time as a comparison example.

Here, for comparison, FIGS. 4 and 5 illustrate diagrams when a desired developing bias voltage is applied at one time without applying the developing bias voltage in multiple steps. FIGS. 4 and 5 are diagrams illustrating a state in which the developing bias voltage is set up at one time as a comparison example. FIG. 4 is an example in which carrier adhesion occurs and FIG. 5 is an example in which stain occurs. In FIGS. 4 and 5, a vertical axis indicates a potential and a horizontal axis indicates time. In addition, in FIGS. 4 and 5, a graph 51 indicates transition of the developing bias and a graph 52 indicates transition of a surface potential of the photoconductive element 20. In FIGS. 4 and 5, the charger 10 is turned on and the surface potential is started to change at the time t1. The developing bias voltage is turned on at the time t2. In this case, as illustrated in FIG. 4, a difference of the surface potential of the developing roller 31 is increased with the lapse of time. Therefore, the carrier adheres to the surface of the photoconductive element 20. As a result, image failure occurs.

In addition, as illustrated in FIG. 5, if application of the developing bias is made at the timing of the time t1 to prevent carrier adhesion, the developing bias and the surface potential are reversed. Therefore, the stain occurs. As a result, the image failure occurs or it is necessary to perform processing so that the stain does not occur in the image.

Then, in the image forming apparatus 100 of the embodiment, different voltages are applied to the developing roller 31 at a predetermined timing by changing the developing bias in multiple steps in accordance with Expression 1 described above.

As described above, the image forming apparatus 100 of the embodiment changes the developing bias voltage in multiple steps due to the charging bias voltage while changing the charging bias voltage in one step. The number of switching occurrences of the developing bias voltage is equal to or greater than three times and more preferably equal to or greater than five times. If the number of changes of the developing bias voltage is increased, the developing bias voltage may be applied in accordance with the change of the charging potential.

Moreover, in the embodiment described above, the charging bias voltage is changed so that an absolute value of the charging potential is increased, but may be changed so that the absolute value of the charging potential is decreased. For example, the charging bias voltage is changed from −600 V to −550 V and the developing bias voltage is changed from −400 V to −3500 V.

In this case, the changing amount of the charging potential is (Vg1−Vg2)/(L1/Vp). An absolute value of the changing amount is |Vg1−Vg2|/(L1/VP).

Here, if the charger 10 has contrasting right and left shapes, the charging bias voltage is changed from −600 V to −550 V due to the charging bias voltage change from the point d1 to a position of a point d4 that is in a right and left symmetry position with the point d2. A point that the developing bias voltage is also changed in multiple steps in accordance with the change is the same as the embodiment described above. However, the timing when the developing bias voltage is changed becomes timing when L2/Vp (sec) has elapsed after the charging voltage is changed. After the developing bias voltage application section 40 applies the developing bias voltage after changed to the developing roller 31, a size (absolute value) of the developing bias voltage is decreased during (L2−L1)/Vp (sec).

The developing bias voltage set-up control according to another embodiment will be described with reference to FIG. 6. The same reference numerals are given to the same contents as the embodiment described above.

Figure 6:
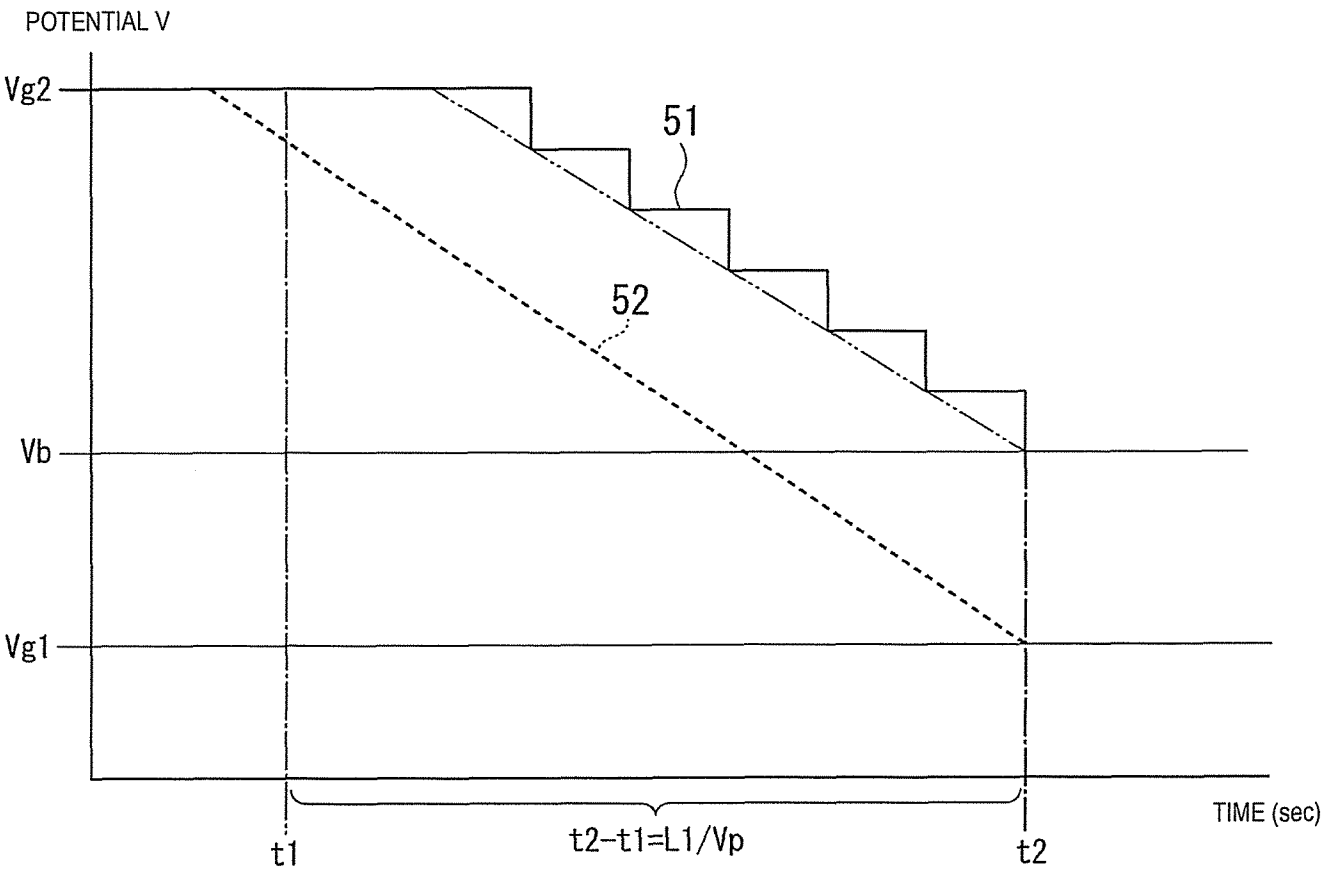
FIG. 6 is a diagram representing a developing bias set-up control according to another embodiment.

FIG. 6 is a diagram representing the developing bias set-up control according to another embodiment. A change of the potential of the photoconductive element 20 passing through the point d3 when charging is started with respect to the uncharged photoconductive element 20 and the developing bias voltage that is applied at this time are represented in FIG. 6. The potential of the point d1 is changed from an uncharged state to −600 V at a moment when the application of the charging bias voltage is started in the charger 10. In this case, the point d2 is substantially uncharged and a potential difference occurs in the photoconductive element 20 with the start of charging.

A slope of the graph 52 of FIG. 6 is (Vg2−Vg1)/(L1/Vp) (V/sec) . . . (Expression 2). A size (absolute value of the changing amount) of the slope is |Vg2−Vg1|/(L1/Vp). Thus, the change of the developing bias voltage also sets up the developing bias voltage in multiple steps so as to have the same slope.

It is possible to prevent carrier adhesion and unnecessary toner from adhering to the photoconductive element 20 by setting up the developing bias voltage in multiple steps while setting up the charging bias voltage in one step.

The timing when the application of the developing bias voltage is started is timing when (L2−L1)/Vp (sec) has elapsed from the start of charging. Thereafter, the application of the developing bias voltage is started. Then, the developing bias voltage application section 40 sets up the developing bias stepwise so that the developing bias is set up to a predetermined developing bias value before a predetermined time L1/Vp (sec) elapses.

Moreover, even when charging is completed, that is, the charging bias voltage is turned off, it goes without saying that control is performed so as to be the same as the charge set-up. The developing bias voltage is decreased in multiple steps so as to be 0 V. Thus, toner adhesion does not occur in an uncharged region after the charge is turned off.

According to the image forming apparatus 100 having such a configuration described above, it is possible to suppress occurrence of image failure such as stain and carrier adhesion. Hereinafter, the effects will be described in detail. In the image forming apparatus 100 of the embodiment, different voltages are applied by changing the developing bias in multiple steps in accordance with the change of Expression 1 described above. Therefore, the potential difference between the developing bias and the surface potential is kept substantially constant. Therefore, it is possible to suppress occurrence of image failure such as stain and carrier adhesion.

In addition, according to the image forming apparatus 100 having such a configuration described above, the number of switching occurrences of the voltage is performed multiple times (for example, five times). Therefore, it is easy to match the potential of the developing bias to the change of the charging bias. Therefore, it is possible to suppress occurrence of image failure.

Hereinafter, modification examples will be described.

The charger 10 may be a roller charger disposed to come into contact with or come close to the photoconductive element 20. In addition, the charger 10 may be other devices as long as the surface of the photoconductive element is charged in a wide-angle.

According to at least one embodiment described above, the image forming apparatus 100 includes the charger 10, the charging voltage application section 12, the exposing device 13, the developing device 30, and the developing bias voltage application section 40. The charger 10 charges the surface of the photoconductive element 20 by discharging in a wide-angle. The charging voltage application section 12 applies the charging bias voltage to the charger 10. The exposing device 13 forms the electrostatic latent image on the charged photoconductive element 20. The developing device 30 causes toner to adhere to the electrostatic latent image formed on the photoconductive element 20. The developing bias voltage application section 40 applies the developing bias voltage to the developing device 30. In addition, the charging voltage application section 12 changes the charging bias voltage in one step. The developing bias voltage application section 40 changes the developing bias voltage applied to the developing device 30 in multiple steps besides changing the charging bias voltage in one step. Therefore, it is possible to suppress occurrence of image failure.

A part of functions of the charger 10 in the embodiment described above may be realized by a computer. In this case, a program for realizing the function is stored in a computer readable recording medium. Then, programs stored in the recording medium, in which the program described above is stored, are read by a computer system and may be realized by executing the programs. Moreover, the "computer system" described here includes hardware such as an operating system and a peripheral device. In addition, the "computer readable recording medium" refers to a portable medium, a storage device, and the like. The portable medium is a flexible disc, a magneto-optical disk, a ROM, a CD-ROM, and the like. In addition, the storage device is a hard disk which is built into the computer system and the like. Furthermore, the "computer readable recording medium" holds dynamically programs in a short period of time as a communication line if the programs are transmitted via the communication line. The communication line is a network such as the Internet, a telephone line, and the like. In addition, the "computer readable recording medium" may be a volatile memory within the computer system serving as a server or a client. The volatile memory holds programs for a fixed period of time. In addition, the programs described above may realize a part of the functions described above. In addition, the programs described above may be realized in combination with a program in which the functions described above are already recorded in the computer system.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a charger that charges a surface of a movable image carrier;

a charging bias voltage application section that applies a charging bias voltage to the charger;

a toner carrier that causes toner to adhere to the electrostatic latent image formed in the image carrier; and a developing bias voltage application section that applies a developing bias voltage to the toner carrier, wherein the developing bias voltage application section changes the developing bias voltage applied to the toner carrier in multiple steps, when at least one of an ambient temperature and an ambient humidity is changed in excess of a predetermined range.

2. The apparatus according to claim 1, wherein when charge of the charger is started, if a charging potential at a point d1 of the image carrier closest from the center of a discharge is Vg1, a charging potential at a point d2 of the image carrier farthest away from the center of the discharge in a reaching range of the discharge is Vg2, a distance between the point d1 and the point d2 is L1, and a moving speed of the image carrier is Vp, the developing bias voltage application section performs multiple-step control so that a size of a change of the developing bias voltage substantially becomes |Vg2—Vg1|/(L1/Vp).

3. The apparatus according to claim 1, wherein if a moving speed of the image carrier is Vp, a distance between a point of the image carrier closest to the center of a discharge and a point farthest in a reaching range of the discharge is L1, and a distance between the point of the image carrier closest to the center of the discharge and a point of the image carrier closest to the toner carrier is L2, if an applied voltage is changed to a voltage of which a size of an absolute value is greater than a voltage that is currently applied, the developing bias voltage application section changes the developing bias voltage within a time from (L2–L1)/Vp to L1/Vp.

4. The apparatus according to claim 1, wherein if a moving speed of the image carrier is Vp, a distance between a point of the image carrier closest to the center of a discharge and a point farthest in a reaching range of the discharge is L1, and a distance between the point of the image carrier closest to the center of the discharge and a point of the image carrier closest to the toner carrier is L2, if an applied voltage is changed to a voltage of which a size of an absolute value is smaller than a voltage that is currently applied, the developing bias voltage application section changes the developing bias voltage within a time from L2/Vp to (L2–L1)/Vp.

5. A voltage applying method comprising:

charging a surface of a movable image carrier;

applying a charging bias voltage to a charger;

causing toner to adhere to the electrostatic latent image formed in the image carrier; and applying a developing bias voltage to a toner carrier, changing the developing bias voltage applied to the toner carrier in multiple steps, when at least one of an ambient temperature and an ambient humidity is changed in excess of a predetermined range.

* * * * *